US006652081B2

(12) United States Patent
Shimizu

(10) Patent No.: US 6,652,081 B2
(45) Date of Patent: Nov. 25, 2003

(54) INK JET PRINTER HEAD

(75) Inventor: Seiji Shimizu, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/289,364

(22) Filed: Nov. 7, 2002

(65) Prior Publication Data

US 2003/0090540 A1 May 15, 2003

(30) Foreign Application Priority Data

Nov. 9, 2001 (JP) ..... 2001-345199

(51) Int. Cl.[7] ..... B41J 2/175
(52) U.S. Cl. ..... 347/85; 347/86
(58) Field of Search ..... 347/86, 85

(56) References Cited

U.S. PATENT DOCUMENTS 5,402,159 A 3/1995 Takahashi et al. ..... 347/9
5,790,158 A * 8/1998 Shinada et al. ..... 347/86
6,145,974 A * 11/2000 Shinada et al. ..... 347/87
6,422,691 B2 * 7/2002 Kobayashi et al. ..... 347/86

FOREIGN PATENT DOCUMENTS

JP A 8-276586 10/1996

* cited by examiner

*Primary Examiner*—Thinh Nguyen
(74) *Attorney, Agent, or Firm*—Oliff & Berridge, PLC

(57) ABSTRACT

A head holder includes a bottom plate of which a bottom surface is fixed to a top surface of a recording head having an ink supply port. A sleeve is fixed to the top surface of the recording head and communicates with the ink supply port. The bottom plate is formed with a recess in which a large diameter tubular part of the sleeve is held. A backup plate encloses a small diameter tubular part of the sleeve and is supported by the bottom plate. An O-ring is inserted around the small diameter tubular part of the sleeve in the backup plate, and an upper end of the sleeve is aligned with an outlet of an ink path in a passage plate laid horizontally in a container, and the passage plate and the bottom plate are fastened using a fixing plate and a bolt. The O-ring is resiliently deformed via the backup plate, so that a gap in a connection between the outlet and the sleeve is sealed.

19 Claims, 20 Drawing Sheets

INK JET PRINTER HEAD

BACKGROUND OF THE INVENTION

1. Field of Invention

The invention relates to the structure of an ink jet recording apparatus of piezoelectric type and, more particularly, to the structure of an ink jet printer head including a sealing structure between a recording head and an ink path.

2. Description of Related Art

Conventionally, ink jet recording apparatuses are known which record on a recording medium, such as a sheet of paper, by ejecting droplets of ink thereon from the nozzles in a recording head based on input signals. In Japanese Laid-Open Patent Publication No. 8-276586, for example, the recessed part almost coinciding with the outer periphery of a recording head main body is formed to the rear surface of a head holder and connection ports are provided to the positions opposed to the ink supply ports. Edge parts protruding from the bottom surface of the recessed part are formed to the peripheries of the connection ports so as to become slightly outside from the inner peripheral surfaces of the ink passages. A space for absorbing an adhesive is formed to the inner periphery of each of the connection ports and a gap housing the adhesive is ensured on the other side.

In this case, the adhesive applied between the ink supply ports and the corresponding connection ports is poured into the ink supply ports, which interferes with ink supply. Therefore, in the known art, the outer periphery of each ink supply port is surrounded by the head holder, an edge part protrudes from the outer periphery of the ink supply port, and an adhesive is applied to the outer periphery of the edge part to fix the recording head.

As described above, once the adhesive is applied, it is difficult to replace the head holder and a circuit board with new ones.

SUMMARY OF THE INVENTION

The invention provides an ink jet printer head that prevents the occurrence of ink leakage and facilitates maintenance, such as part replacement.

In one aspect of the invention, an ink jet printer head includes a head holder that includes a supporting plate; a recording head that includes an array of nozzles on a bottom surface through which ink is ejected and an ink supply port on a top surface that supplies ink to the nozzles, the recording head fixed on the supporting plate; an ink path forming member that includes an ink path and an outlet and is fixed on a top surface of the supporting plate; a tubular sleeve that protrudes from the ink supply port of the recording head and is disposed so as to allow communication between the recording head and the outlet of the ink path; a backup plate that encloses a perimeter of the sleeve and is interposed between the recording head and the ink path forming member; an annular resilient sealing member that is inserted around the perimeter of the sleeve between the backup plate and the ink path forming member; and a fastener that fastens the backup plate to the ink path forming member. The annular resilient sealing member is resiliently deformed by the backup plate so as to prevent ink leakage from a connection between the perimeter of the sleeve and the outlet of the ink path.

Therefore, the outlet of the ink path in the ink path forming member on the head holder, which is fixed to the recording head, is not directly adhered to the sleeve, which is fixed to the recording head. The annular resilient sealing member inserted around the perimeter of the sleeve is pressed by the backup plate, so that a gap between the outlet and the sleeve is sealed. In addition, when the recording head or the ink path forming member is replaced, the sealed fit can be released by removing the backup plate only, and the parts are easily separable.

BRIEF DESCRIPTION OF THE DRAWINGS

The invention will be described in greater detail with reference to embodiments thereof and the accompanying drawings wherein.

DETAILED DESCRIPTION OF PREFERRED EMBODIMENTS

Figure 1:
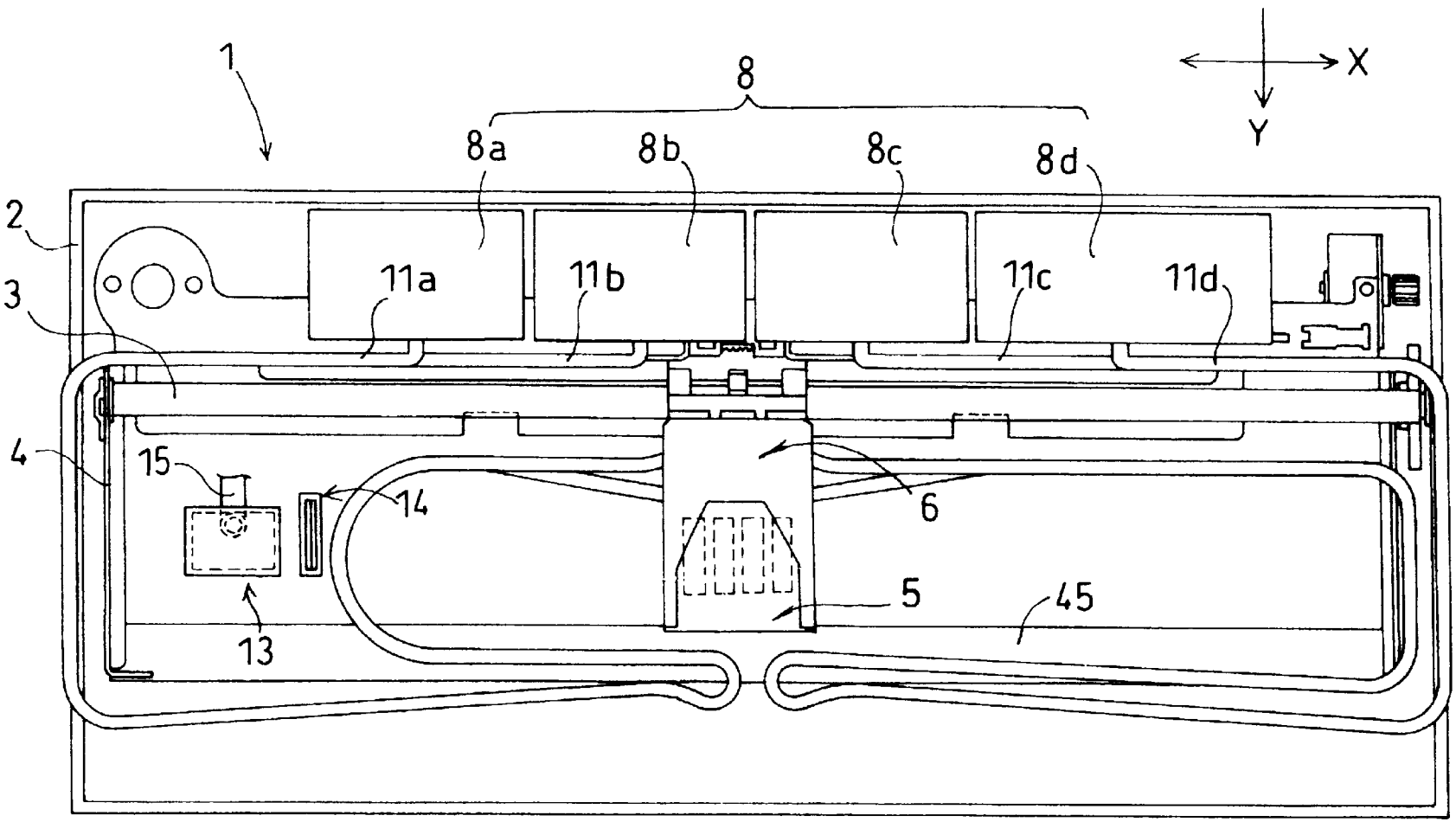
FIG. 1 is a plan view of an ink jet recording apparatus according to an embodiment of the invention.
Figure 3:
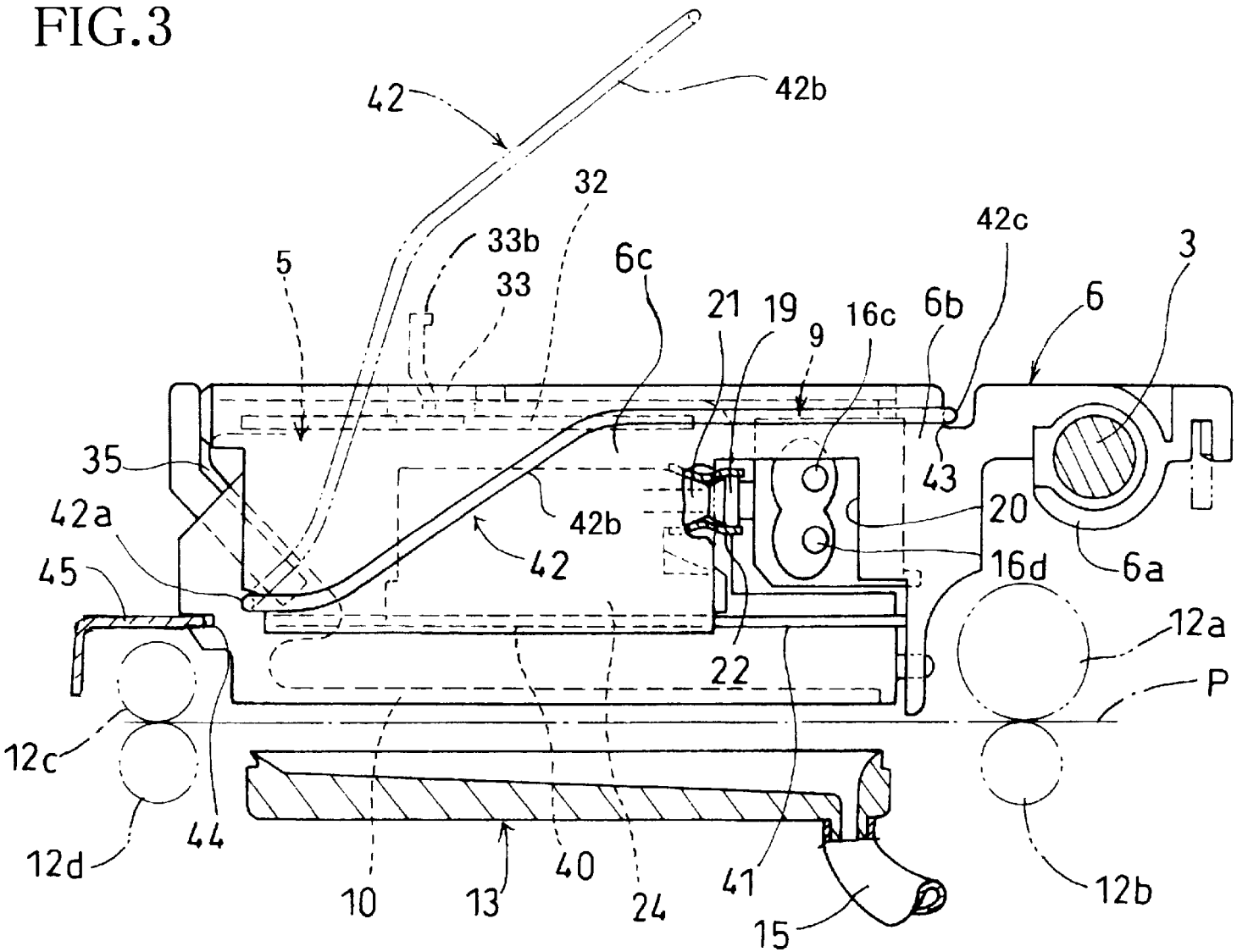
FIG. 3 is a side elevational view of the ink jet head unit.

An embodiment of the invention will be described in detail with reference to the accompanying drawings. Referring to FIG. 1, essential parts of an ink jet recording apparatus 1 will be described. A main guide rail 3 and a sub-guide rail 45, which extend in the right and left directions (x direction shown in FIG. 1, hereinafter referred to as a main scanning direction), are fixed in a frame 4 in a body case 2 of the ink jet recording apparatus 1. A scanning carriage 6 to which an ink jet head unit 5 is detachably mounted, is movably attached to the main guide rail 3 and the sub-guide rail 45, so as to be moved back and forth in the main scanning direction within a specified range by a timing belt and a drive motor, which are not shown. A sheet of paper P, as an example of a recording medium, is fed in a Y direction (hereinafter referred to as a sub-scanning direction). To do so, a feeding device including a pair of conveying rollers 12*a*, 12*b* upstream of a conveying direction, and a pair of conveying rollers 12*c* and 12*d* downstream thereof, as shown in FIG. 3, are provided below the ink jet head unit 5.

In the ink jet head unit 5, recording heads 10 and a container 24 (FIG. 5), integrally formed with four ink paths for four color inks and placed on the recording heads 10, are mounted in a head holder 7, which has a substantially box shape and an upper open structure. The head holder 7 is detachably connected to the scanning carriage 6 in a substantially horizontal direction.

In FIG. 1, ink cartridges 8*a*, 8*b*, 8*c*, 8*d*, individually storing four color inks (magenta, yellow, cyan, and black) as ink supply sources, are arranged in a horizontal row beneath the feed path along which the sheet P is fed during printing. The ink cartridges 8*a*, 8*b*, 8*c*, and 8*d* are connected to ink supply tubes 11*a*, 11*b*, 11*c*, and 11*d* at their proximal ends. The ink supply tubes 11*a*, 11*b*, 11*c*, and 11*d* are formed of a flexible synthetic resin and connected to a joint 9 (FIG. 2) designed for supplying ink fixed in the scanning carriage 6. Ink is supplied from the joint 9 via the ink paths in the container 24 to the appropriate recording heads 10.

In the embodiment, two recording heads 10 are disposed in parallel to each other. Each of the recording heads 10 has two arrays of nozzles, each array comprising a plurality of nozzles arranged in a line. The array of nozzles extend in a sub-scanning direction (Y direction in FIG. 1). The arrays of nozzles are individually assigned for four colors (magenta, yellow, cyan, and black) for color image formation. Ink of each color is ejected downwardly from the nozzles located on the lower surface of the recording head 10, to be adhered to the surface of a sheet P (shown in FIG. 3).

At the left side of the body case 2 (FIG. 1) (end part of the moving range of the scanning carriage 6), are a suction cap 13 for suction purge and a wiper blade 14 for wiping the surface of each of the recording heads 10. The suction cap 13 and the wiper blade 14 are disposed to face the recording heads 10. During a suction purge operation, the suction cap 13 moves to cover the front (lower or downward facing) surface of each of the recording heads 10. A suction pipe 15 is connected between the suction cap 13 and a waste tank (not shown). The waste tank is provided in, for example, one of the ink cartridges 8*a* to 8*d*. Suction is provided by a suction pump (not shown). Waste ink sucked during the suction purge is ejected to the waste zone. In order to restore the recording heads 10, application of high pressure to ink at the ink cartridge side is used in addition to the suction described above.

Figure 2:
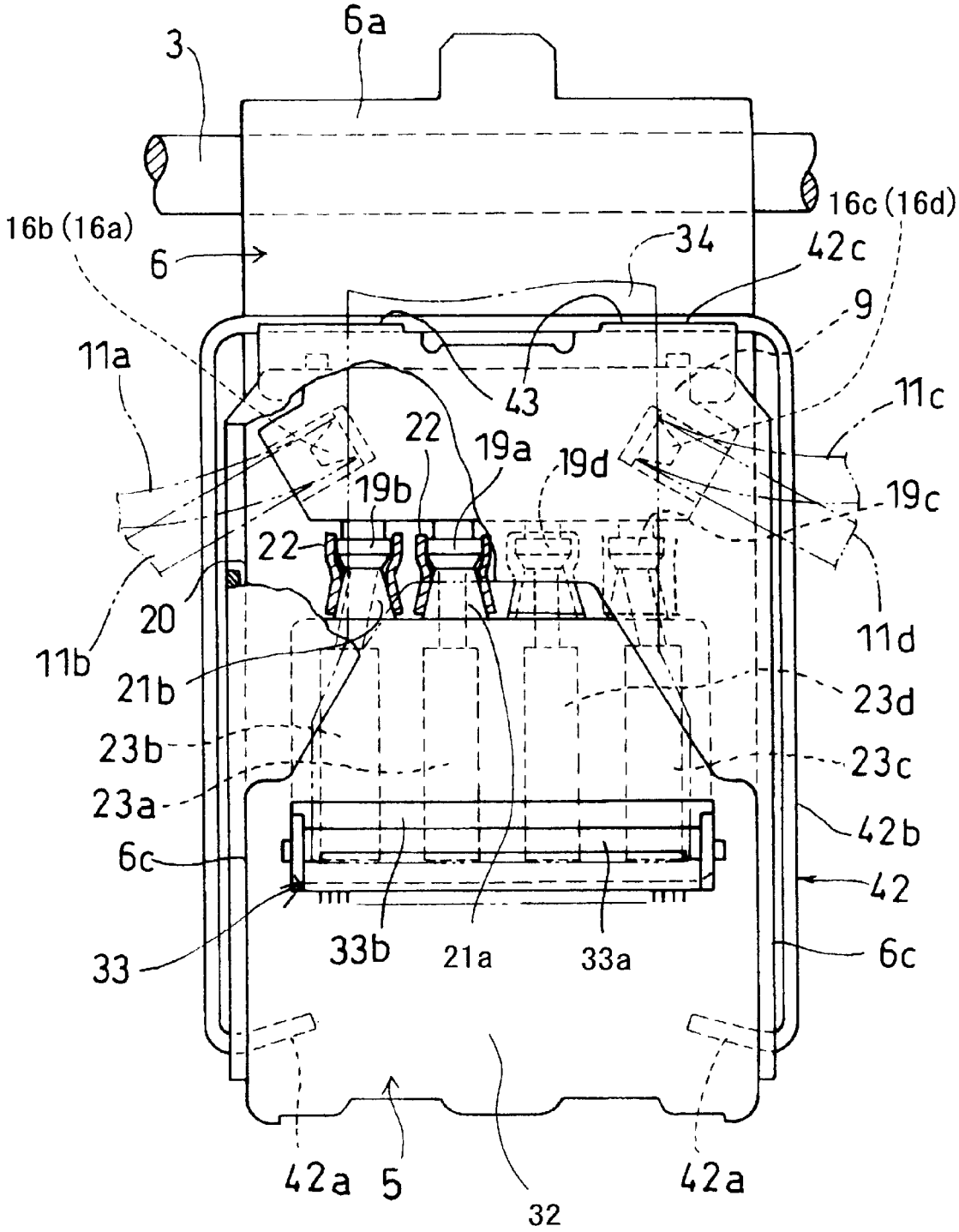
FIG. 2 is a plan view of an inkjet head unit.
Figure 4:
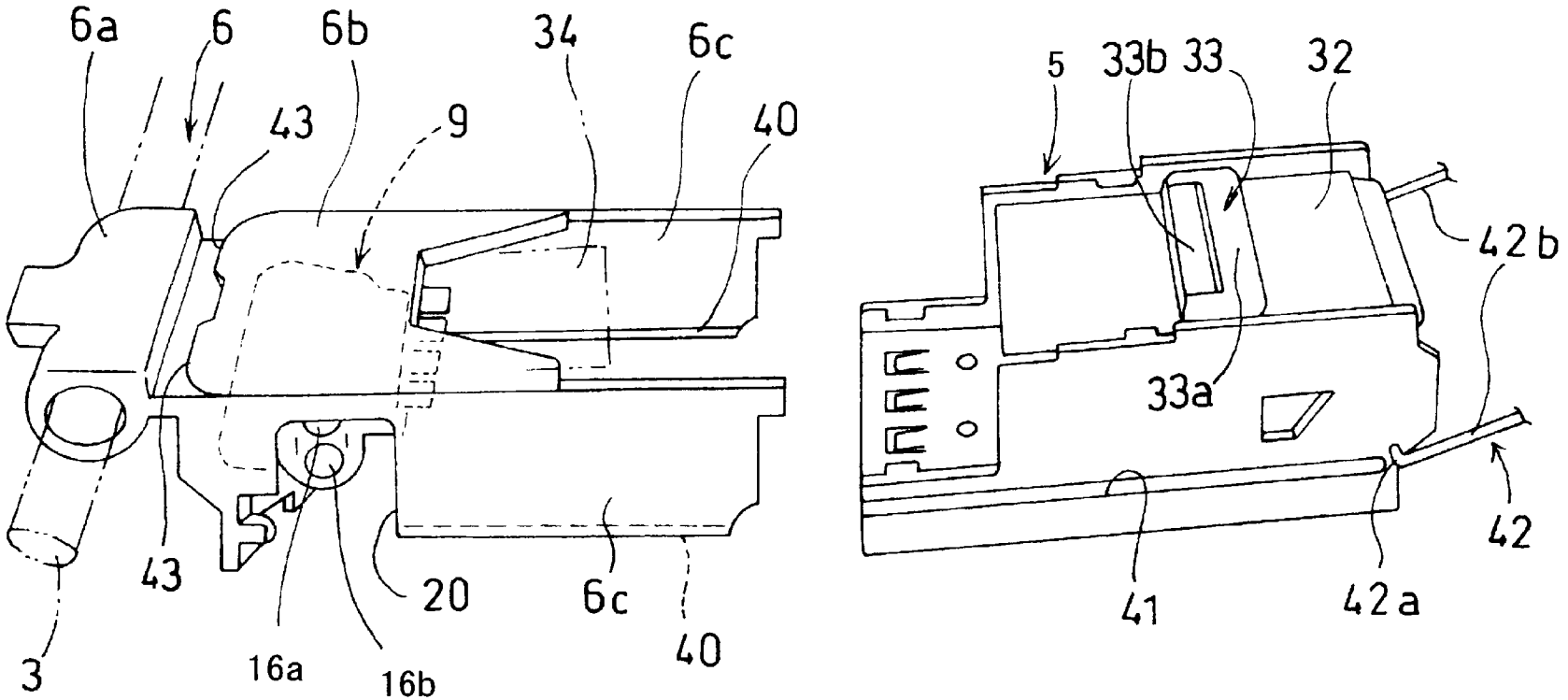
FIG. 4 is a perspective view of the ink jet head unit when a head holder is removed from a scanning carriage.

The structure of the ink jet head unit 5 and the scanning carriage 6 will be described with reference to FIGS. 2 to 5. As shown in FIGS. 2, 3, and 4, the scanning carriage 6 is formed of synthetic resin and made up of a proximal part 6*a* engaged with the main guide rail 3, a joint storing part 6*b* with a space opened at the front of the body case 2 (opposite to the placement of the ink cartridges 8), and a pair of supporting frames 6*c* extending further forward from the joint storing part 6*b*, which are molded in one piece.

The joint 9, formed of synthetic resin, which is fixed inside the joint storing part 6*b*, is an airtight rectangular box, and is long from side to side. As shown in FIG. 2, connection ports 16*a*, 16*b*, 16*c*, 16*d* are provided in openings at both ends of the joint 9. The connection ports 16*a*, 16*b*, 16*c*, 16*d* are fitted in the ink supply tubes 11*a*, 11*b*, 11*c*, 11*d* respectively, which are connected to the ink cartridges 8*a*, 8*b*, 8*c*, 8*d*. In this case, as shown in FIGS. 3 and 4, the joint storing part 6*b* is formed with recesses 20 on both sides. Therefore, the ink supply tubes 11*a*, 11*b*, 11*c*, 11*d* pass through the recesses 20 so that they can be connected to the connection ports 16*a*, 16*b*, 16*c*, 16*d* in a substantially horizontal state.

Inside the joint 9, ink paths (not shown) are provided so that the connection ports 16*a*, 16*b*, 16*c*, 16*d* are communicated to the corresponding ink outlets 19*a*, 19*b*, 19*c*, 19*d*. Each of the ink outlets 19*a*, 19*b*, 19*c*, 19*d* protrudes forward and substantially horizontally from the front face of the joint 9.

Figure 5:
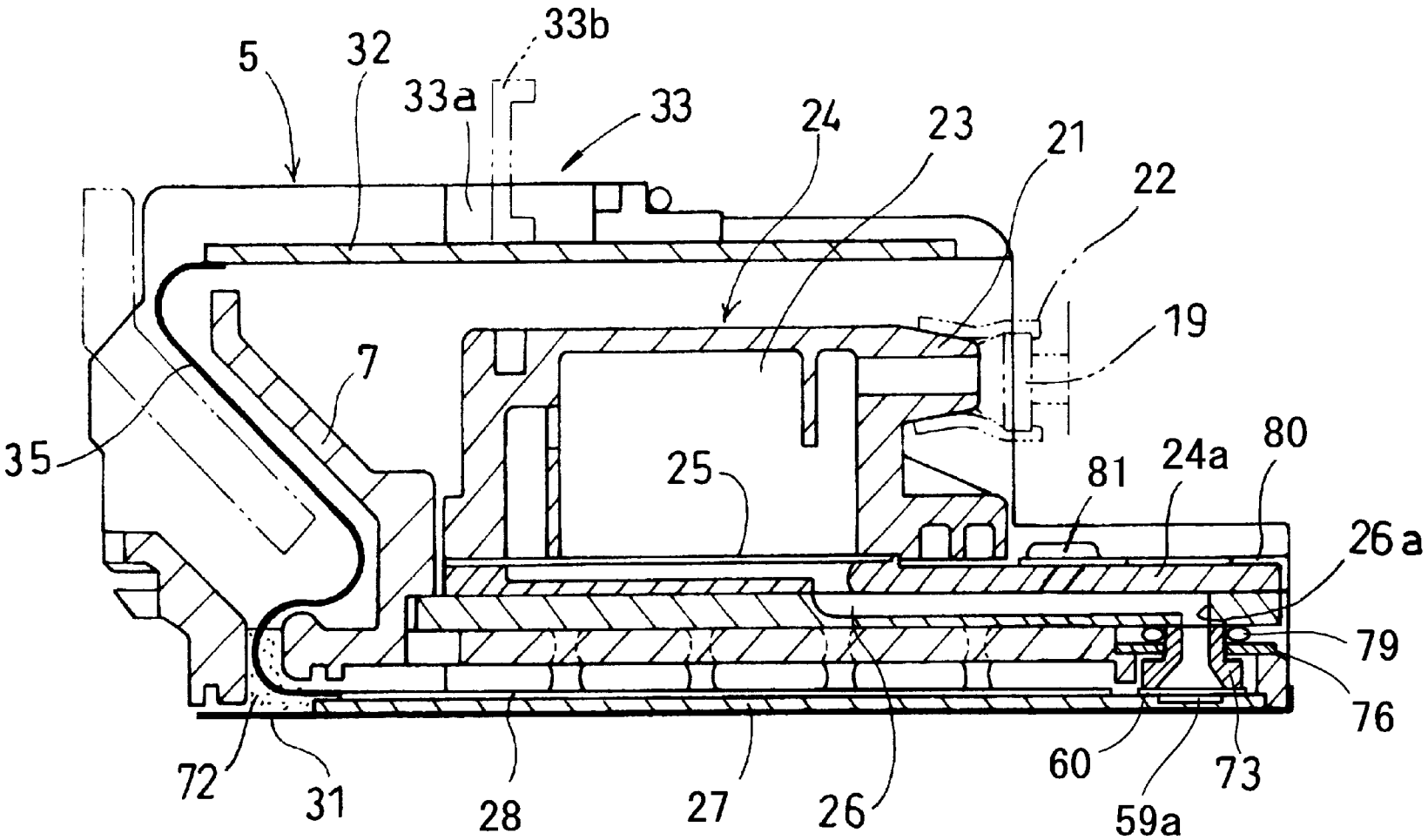
FIG. 5 is a sectional side elevation view of the ink jet head unit.
Figure 10A:
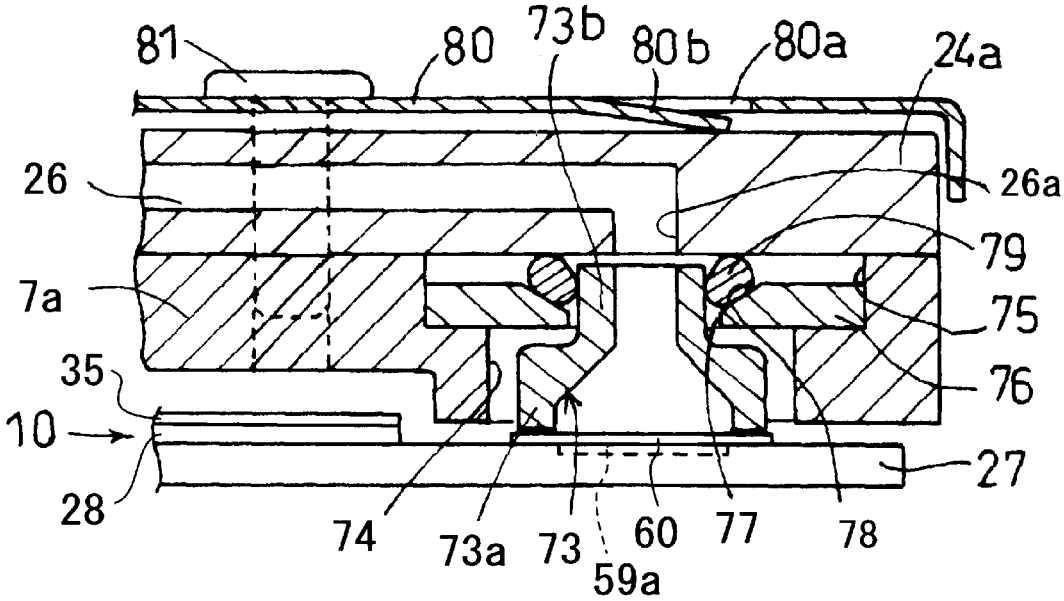
FIG. 10A is an enlarged sectional view of essential parts of a first embodiment of a sealing structure between the recording head and an ink path in a container.

The head holder 7 is an injection molded article made of a synthetic resin, such as polyproethylene or polypropylene. The container 24 is fixed to a bottom plate 7*a* (FIG. 7) of the head holder 7 using a fixing plate 80 and a bolt 81 (FIGS. 5 and 10). Air traps 23*a*, 23*b*, 23*c*, 23*d* (generically 23) are formed in the four ink paths in the container 24. In the air traps 23*a*, 23*b*, 23*c*, 23*d*, four colored inks corresponding to the four arrays of nozzles are respectively collected and air bubbles are trapped.

The container 24 is formed with four ink inlets 21*a*, 21*b*, 21*c*, 21*d* (generically 21 in FIG. 5) projecting rearward and substantially horizontally. The ink inlets 21*a*, 21*b*, 21*c*, 21*d* are positioned at a height so as to face the ink outlets 19*a*, 19*b*, 19*c*, 19*d* (generically 19), respectively. The ink inlets 21*a* to 21*d* and the ink outlets 19*a* to 19*d* are connected via tubular seal rings 22 fitted over the ink outlets 19*a* to 19*d* so that the ink inlets 21*a* to 21*d* are hermetically sealed. The seal rings 22 are preferably formed of a resilient material, such as silicone rubber, urethane rubber, nitrile-butadien rubber (NBR), isoprene rubber, butylene rubber, or fluorine rubber.

Therefore, ink in each ink cartridge 8 is fed to the corresponding supply tube 11, the joint 9, the corresponding ink inlet 21, and the corresponding air trap 23, and then supplied to the corresponding array of nozzles 55.

Figure 16:
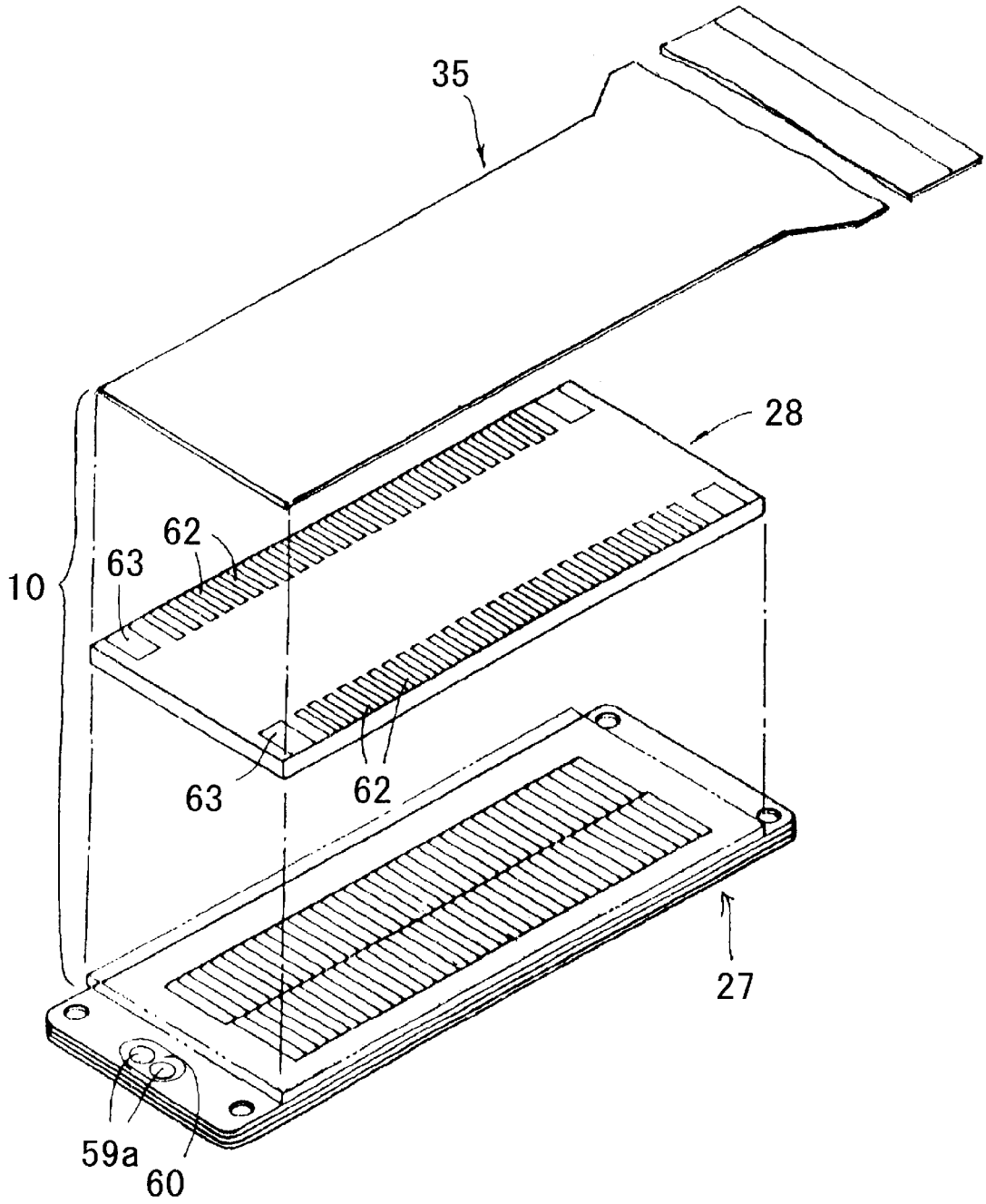
FIG. 16 is a perspective view of the recording head.
Figure 20:
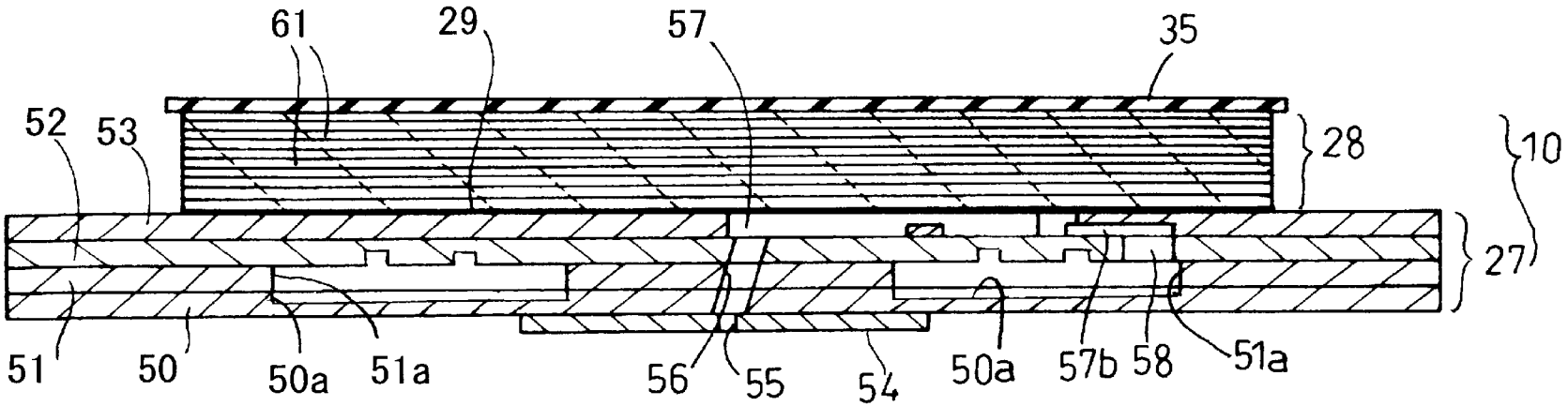
FIG. 20 is an enlarged sectional view of essential parts of the recording head.

The structure of the recording heads 10 and a structure and method to fix the recording heads 10 to the bottom surface of the bottom plate 7*a* of the head holder 7 with the arrays of the nozzles of the recording heads 10 spaced precisely will be described with respect to one recording head 10 and the basic components thereof. As shown in FIGS. 16 and 20, one recording head 10 includes a cavity plate unit 27, a piezoelectric actuator 28, and a flexible flat cable 35. The cavity plate unit 27 is formed of several layered metal plates. The piezoelectric actuator 28 is adhered to the cavity plate unit 27 via an adhesive or an adhesive sheet 29 (FIG. 20), and the flexible flat cable 35 is bonded to the top of the piezoelectric actuator 28 for electric connection with external equipment.

Figure 17:
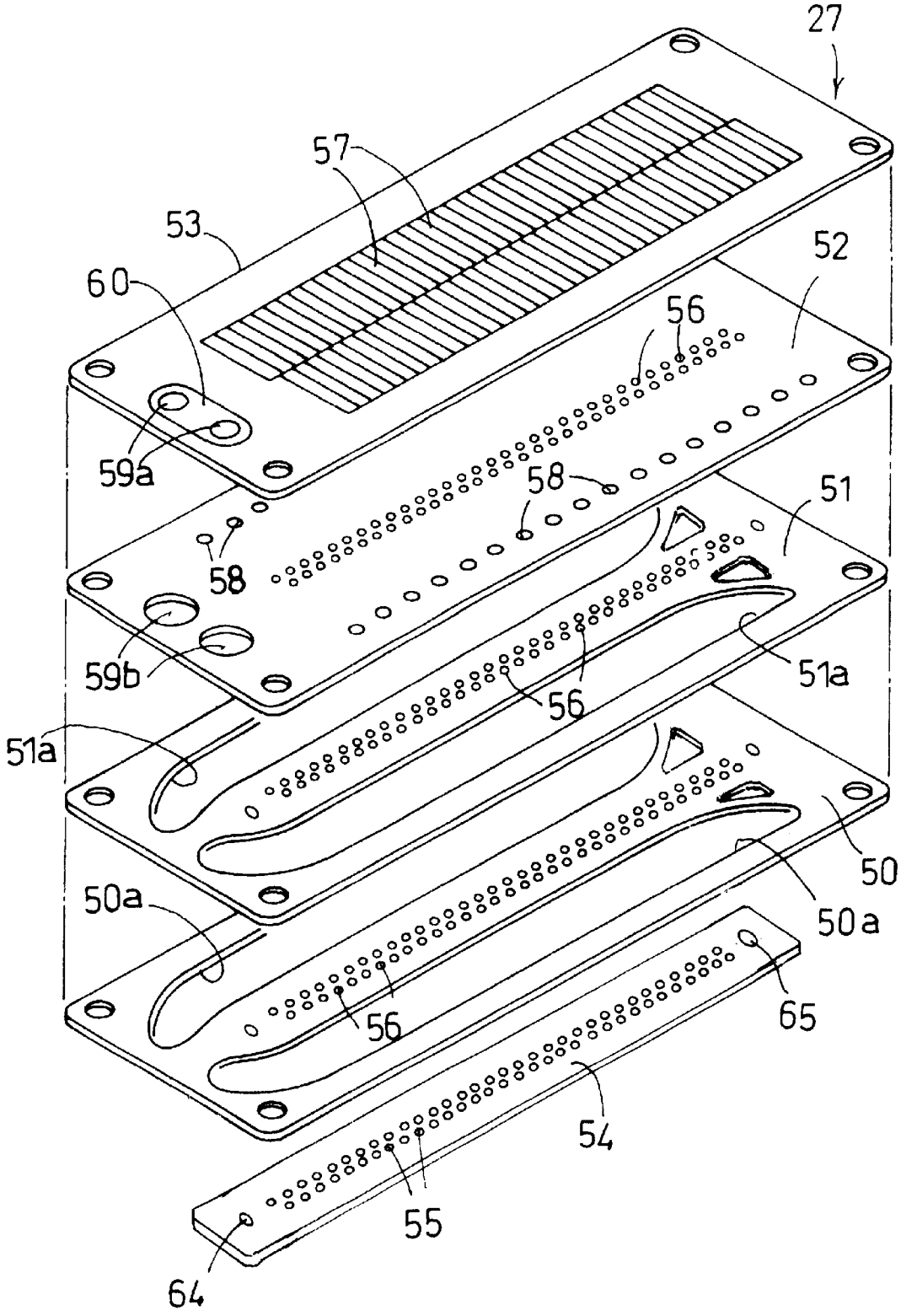
FIG. 17 is a perspective view of parts of a cavity plate unit.

A filter 60, for eliminating dust in the ink supplied from the container 24, is adhesively fixed over ink supply ports 59*a* drilled on one side of the base plate 53, which is the top layer of the cavity plate unit 27, on the bottom surface side of the recording head 10 (FIGS. 16 and 17).

Figure 18:
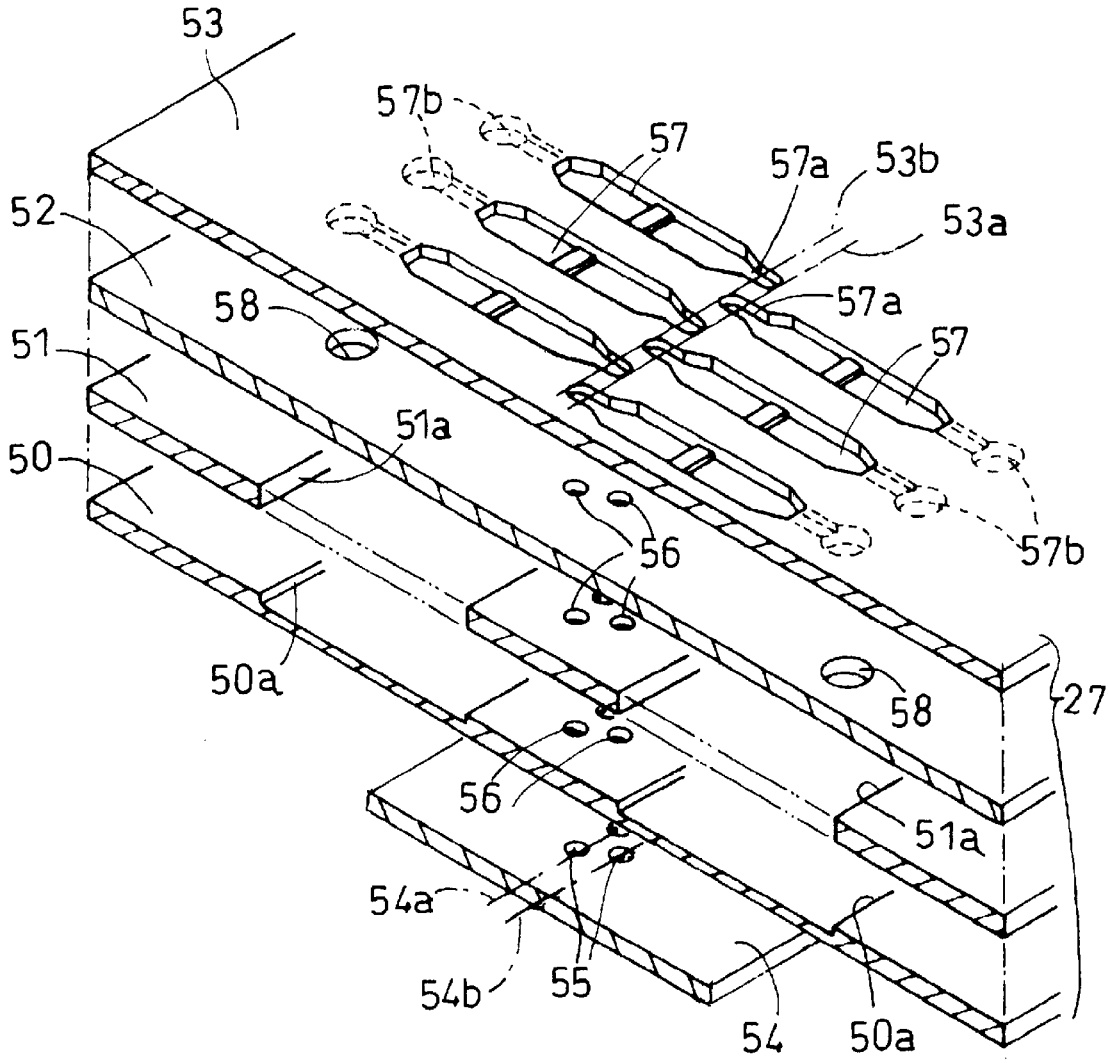
FIG. 18 is a partially enlarged perspective view of the cavity plate unit.

As shown in FIGS. 17 and 18, the cavity plate unit 27 includes a nozzle plate 54 and four thin metal plates: two manifold plates 50, 51, a spacer plate 52, and the base plate 53, which are adhesively bonded to each other. In this embodiment, each plate is made of steel alloyed with 42% nickel and has a thickness of 50 $\mu$m–150 $\mu$m. The nozzle plate 54 has two rows of staggered nozzles 55 along a first direction (longitudinal direction). In other words, along two parallel reference lines 54*a*, 54*b*, extending in a first direction, the nozzles 55 are drilled in a staggered arrangement with a minimum pitch. The manifold plates 50, 51 are formed with ink chambers 50*a*, 51*a*, extending along the rows of the nozzles 55. The ink chambers 50*a* are recessed in the manifold plate 50 (FIG. 18). The ink chambers 50*a*, 51*a* in the manifold plates 50, 51 are hermetically sealed as the spacer plate 52 is laminated onto the manifold plate 51.

The base plate 53 is formed with a plurality of narrow pressure chambers 57, each of which extends in a second direction (widthwise direction) orthogonal to a centerline along the first direction. Reference lines 53*a*, 53*b*, which are parallel to each other, are set respectively to each side of the centerline. Narrow end portions 57*a* of the pressure chambers 57 on the left of the centerline are disposed on the reference line 53*b*, and the narrow end portions 57*a* of the pressure chambers 57 on the right of the centerline are disposed on the reference line 53*a*. The narrow end portions 57*a* of the pressure chambers 57 on the right and left sides of the centerline are alternately positioned. That is, alternate pressure chambers 57 extend from the narrow end portions 57*a* in direction opposite to each other.

The narrow end portions 57*a* of the pressure chambers 57 communicate with the nozzles 55 of the nozzle plate 54 via small diameter staggered through holes 56 drilled in the spacer plate 52 and the manifold plates 50, 51. Other end portions 57*b* of the pressure chambers 57 communicate with the ink chambers 50*a*, 51*a* in the manifold plates 50, 51 via ink supply holes 58 drilled on opposite sides of the spacer plate 52.

As shown in FIGS. 18 and 20, the other end portions 57*b* of the pressure chambers 57 are recessed on the lower surface of the base plate 53. The ink supply ports 59*a*, 59*b* (FIG. 17), which communicate with the ink chambers 50*a*, 51*a*, are drilled on an end portion of the base plate 53 and the spacer plate 52.

With this structure, the ink flows into the ink chambers 50*a*, 51*a* from the ink supply ports 59*a*, 59*b*, passes from the ink chambers 51*a* to the ink supply holes 58, and is distributed into each of the pressure chambers 57. The ink passes from the pressure chambers 57 to the nozzles 55 via the through holes 56 (FIG. 20).

Figure 19:
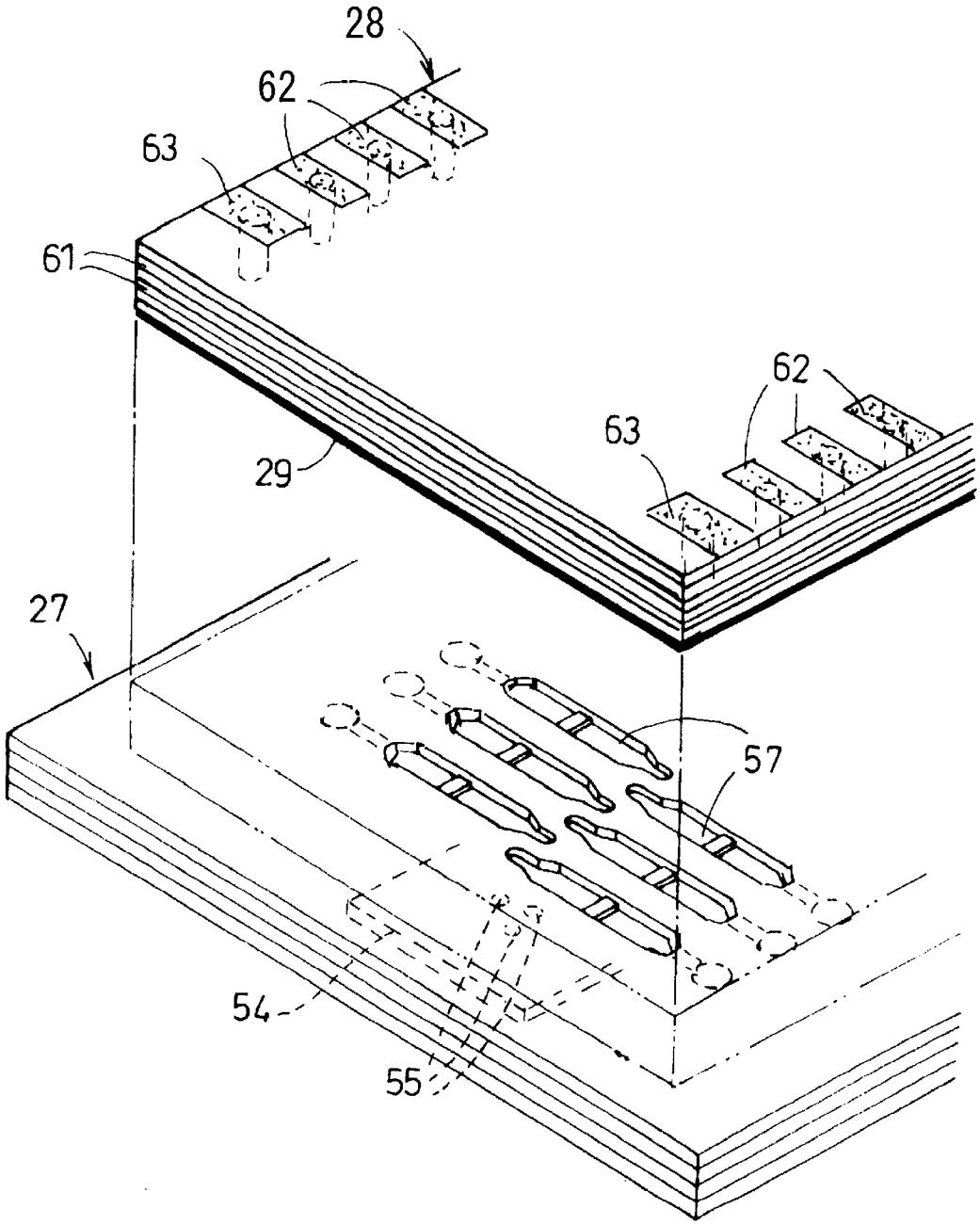
FIG. 19 is a perspective view showing a positional relationship between the cavity plate unit and a piezoelectric actuator.

The piezoelectric actuator 28 is structured wherein a plurality of piezoelectric sheets 61 are laminated one above the other as shown in FIGS. 19 and 20. As in the case disclosed in U.S. Pat. No. 5,402,159 (the disclosure of which is incorporated by reference), narrow electrodes (not shown) are formed with respect to each of the pressure chambers 57 on upper surfaces of the lowest piezoelectric sheet 61 and the even piezoelectric sheets 61, counted upward from the lowest one along the first direction. On upper surfaces of the odd piezoelectric sheets 61, counted from the lowest one, common electrodes (not shown) are formed with respect to some pressure chambers 57. Surface electrodes 62, 63 are provided on the top surface of the piezoelectric actuator 28 along the edges of the long sides. The surface electrodes 62 are electrically connected to each of the narrow electrodes and the surface electrodes 63 are electrically connected to the common electrodes (FIG. 19.)

The piezoelectric actuator 28 is fixedly laminated to the cavity plate unit 27 in such a manner that each of the narrow electrodes in the piezoelectric actuator 28 is associated with a one of the pressure chambers 57 in the cavity plate unit 27. As the flexible flat cable 35 is overlaid on the piezoelectric actuator 28, various wiring patterns (not shown) in the flexible flat cable 35 are electrically connected to the surface electrodes 62, 63 (FIG. 16).

With this structure, when a voltage is applied between one of the narrow electrodes and one of the common electrodes in the piezoelectric actuator 28, the piezoelectric sheets 61 are deformed, at the position of the narrow electrode to which the voltage is applied, by piezoelectric effect in a direction where the sheets are laminated. By this deformation, the volume of the pressure chamber 57 corresponding to the narrow electrode is reduced, causing ink stored an the pressure chamber 57 to be ejected as a droplet from the associated nozzle 55, thereby performing printing.

The number of the recording heads 10 can be two to four. The cavity plate unit 27 in each of the recording heads 10 may be made of ceramics in addition to metal. Further, the ink jet printer of the invention is driven by the piezoelectric actuator 28 in the shape of a plate, however, the ink jet printer of the invention may be driven by a piezoelectric actuator in any form. In addition, the ink jet printer may be structured wherein ink is ejected from the nozzles 55 by vibrating a plate covering the reverse side surface of the pressure chambers by static electricity.

Figure 6:
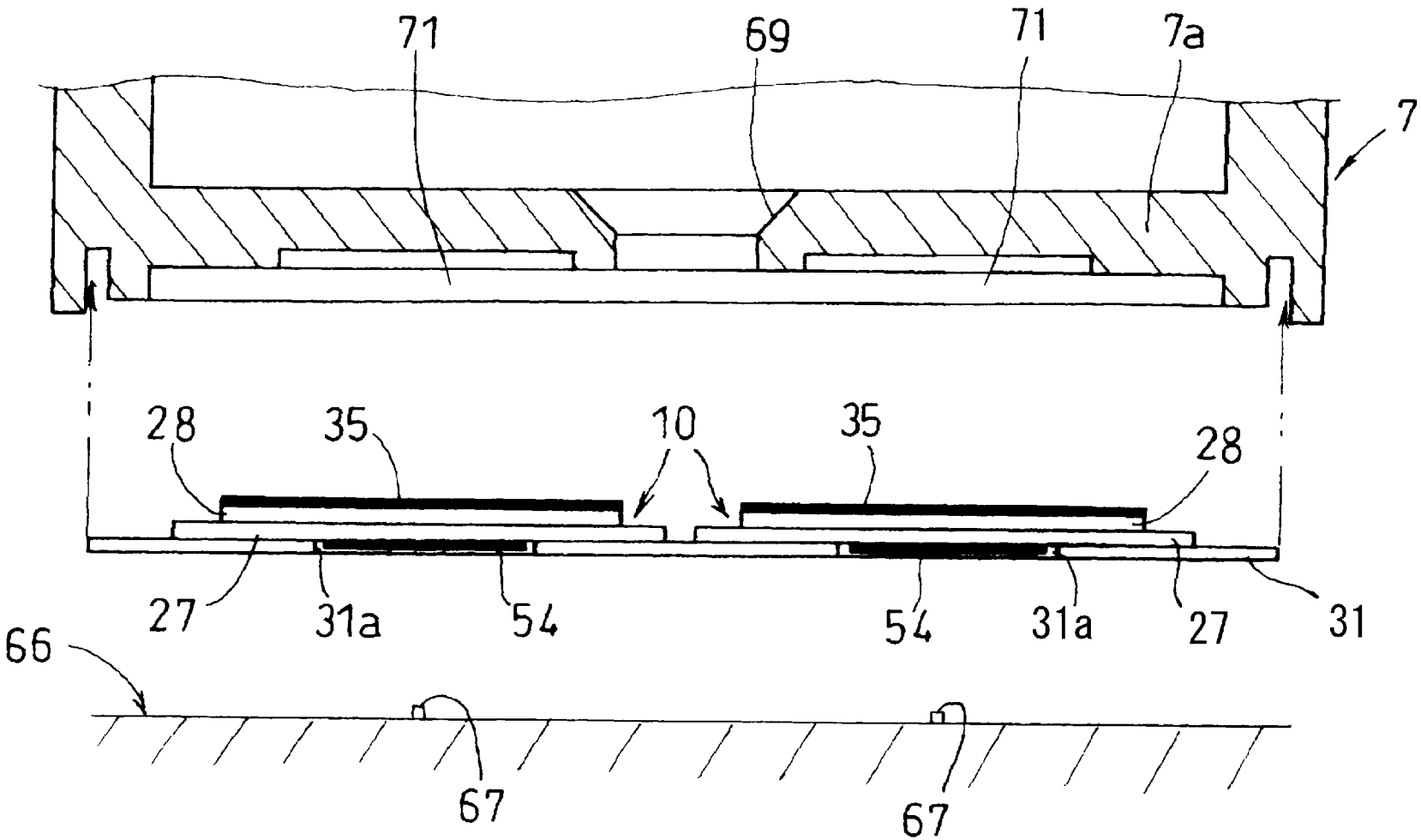
FIG. 6 is a sectional view of essential parts when a cover plate with recording heads is adhesively fixed to the head holder.
Figure 7:
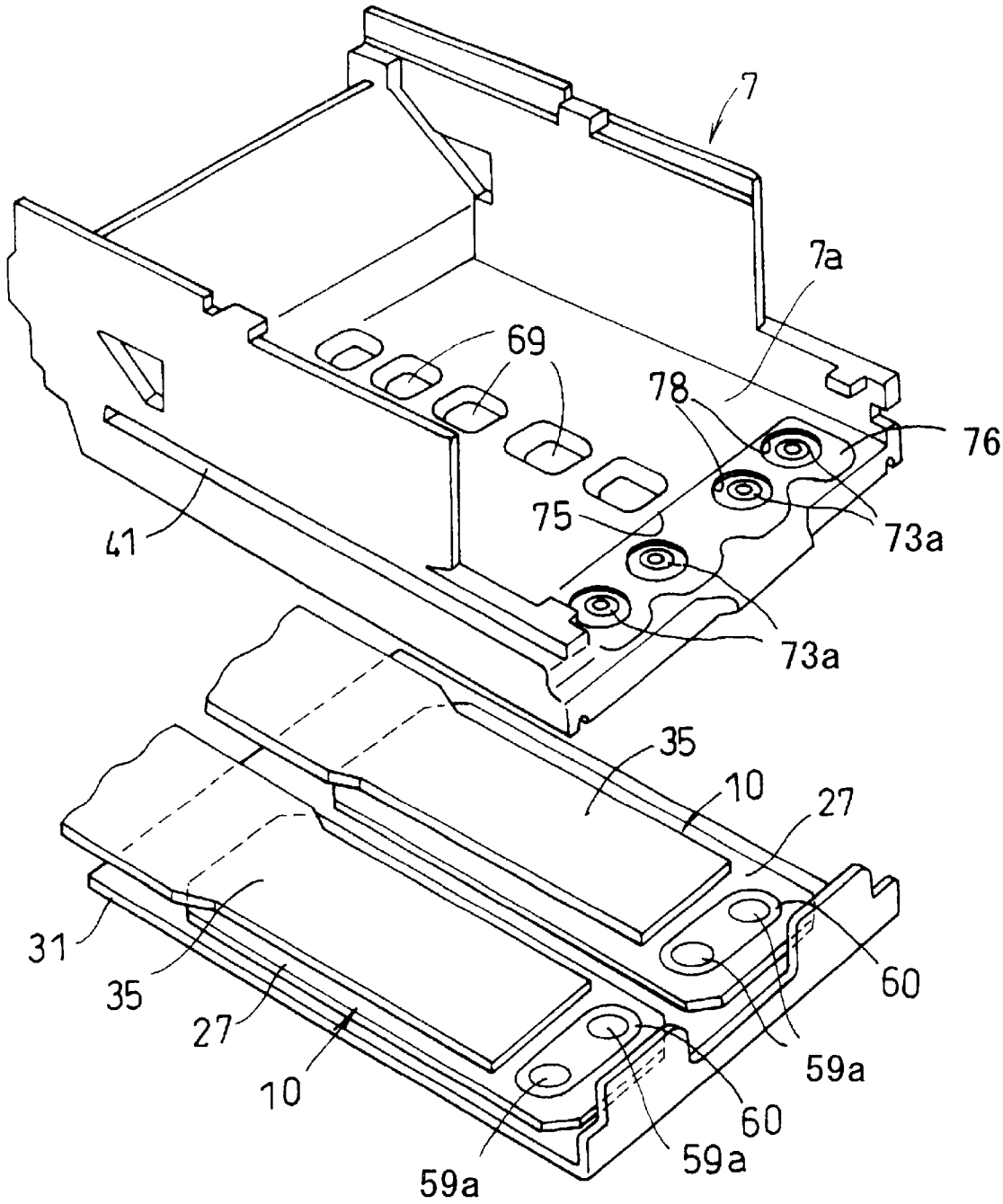
FIG. 7 is a perspective view of the head holder and the cover plate with recording heads.

The formation and method of fixing the two recording heads 10 to the head holder 7 will now be described. As shown in FIGS. 6 and 7, the two recording heads 10 are positioned in parallel on a cover plate 31, which is a thin metal plate, and adhesively affixed thereto. In this case, the cover plate 31 has two windows, or openings, 31*a* to enclose the nozzle plates 54 of the recording heads 10. The windows 31*a* may be formed by a method, such as stamping or cutting.

The nozzle plate 54 of each recording head 10 has positioning holes 64, 65 (FIG. 17) at front and rear ends with respect to the longitudinal direction. As shown in FIG. 6, a jig 66 has positioning pins 67 protruding upward from the surface thereof so as to mate with the positioning holes 64, 65 of the nozzle plates 54. The cover plate 31 is placed on the jig 66, and heat-hardening adhesive, such as an epoxy-base resin, is applied to outer regions around the windows 31*a*, which confront the surfaces of the recording heads 10, on the reverse side surface of the cover plate 31. The positioning holes 64, 65 are fitted onto the positioning pins 67 of the jig 66, and the recording heads 10 are pressed against the cover plate 31. With the application of heat, the recording heads 10 are fixed with a specified clearance and in parallel to each other with respect to the cover plate 31. It is desirable that the cover plate 31 is slightly thicker than the nozzle plates 54.

Figure 8:
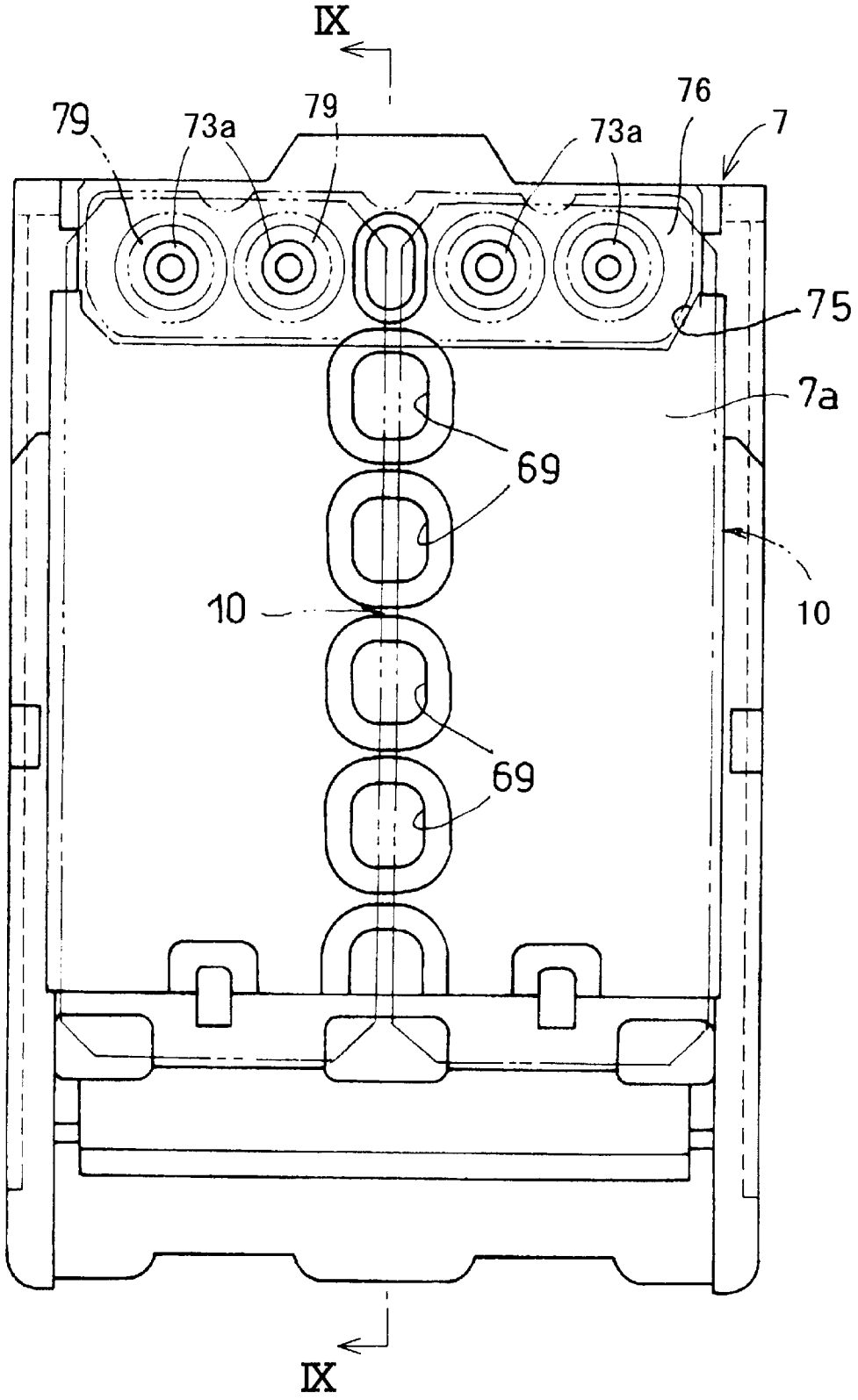
FIG. 8 is a plan view of the head holder.

To adhesively fix the cover plate 31 to the bottom surface of the bottom plate 7*a* of the head holder 7, a plurality of through holes 69 are formed in line in the middle of the bottom plate 7*a* of the head holder 7, as shown in FIGS. 7 and 8, so as to be centered when the recording heads 10 are placed in parallel with each other. A recessed space 71 (FIG. 6), where the recording heads 10 can be fitted in position, is formed on the bottom surface of the bottom plate 7*a*.

Figure 9:
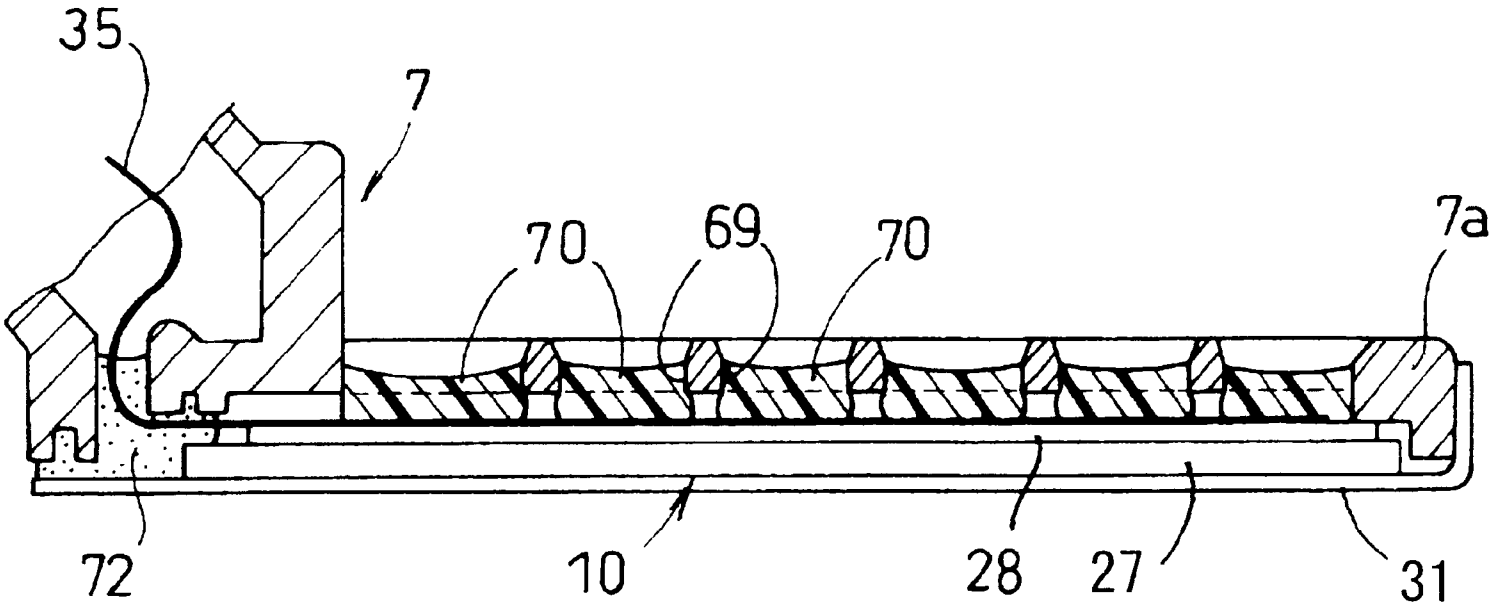
FIG. 9 is a cross sectional view taken along line IX—IX of FIG. 8.

The cover plate 31 and the recording heads 10 are placed in face-to-face relationship with the bottom surface of the head holder 7. Then, a thermoplastic adhesive 70 is poured into the through holes 69 from the top surface of the bottom plate 7*a* to fix the cover plate 31 and the bottom plate 7*a* (FIG. 9). As described above, the two recording heads 10 are first fixed to the cover plate 31 of one metal plate within a given accuracy (within a tolerable range) of the space and parallel relationship between the heads 10. When such a cover plate 31 is connected to the bottom plate 7*a* of the head holder 7 of which a coefficient of linear expansion is greater than that of the cover plate 31, a substantially middle portion of the cover plate 31 and a substantially middle portion of the bottom plate 7*a* are bonded. By doing so, even if the bottom plate 7*a* expands or shrinks due to a change in temperature, the central portion of the bottom plate 7*a* in the width direction (where the recording heads 10 are placed in parallel), and by extension the bonding part with the cover plate 31 do not become misaligned.

If adhesive strength of the recording heads 10 to the cover plate 31 is set to high and adhesive strength between the cover plate 31 and the bottom plate 7*a* is relatively set to low, a change in a pitch among the nozzles 55 of the recording heads 10 due to a change in environmental temperature is dependent only on the coefficient of linear expansion of the cover plate 31 made of metal, and is not affected by expansion or shrinkage due to a change in temperature of the bottom plate 7*a* made of synthetic resin.

The adhesive strength between the periphery of the cover plate 31 and the periphery of the bottom plate 7*a* is low. Therefore, it is preferable that a sealer 72, such as silicone rubber, is filled into the clearance between the periphery of the cover plate 31 and the periphery of the bottom plate 7*a* to prevent ink or dust from entering the head holder 7 from the periphery of the cover plate 31.

Connection between the ink supply ports 59*a* of the recording heads 10 fixed on the bottom plate 7*a* of the head holder 7 and the ink paths 26 formed on the passage plate 24*a* at a bottom of the container 24 will be described. As shown in FIG. 5, to allow fluid communication between the four air traps 23 and the ink supply ports 59*a* of the recording heads 10, the passage plate 24*a* providing the bottom of the container 24 extends toward the ink supply ports 59*a*, and a plurality of ink paths 26 are formed in the passage plate 24*a*. An outlet 26*a* of each of the ink paths 26 is opened in a downward direction toward the ink supply ports 59*a*.

As shown in FIG. 10, four tubular sleeves 73 are disposed so as to communicate with the four ink supply ports 59*a* opened on the upper surfaces of the two cavity plate units 27 of the two recording heads 10. The sleeves 73 are strongly bonded to the filters 60 at their lower end surfaces using an adhesive, such as epoxy resin. Each sleeve 73 is made of a large diameter tubular part 73*a*, which is at the lower part in the cross sectional view, and a small diameter tubular part 73*b*, which is at the upper part in the cross sectional view. The bottom plate 7*a* of the head holder 7 has four storage recesses 74 on the bottom surface thereof, in which the large diameter tubular part 73*a* of each sleeve 73 is fitted, and an elongated recess 75 on the top surface thereof, in which a backup plate 76 is fitted. The storage recesses 74 communicate with the elongated recess 75. An upwardly facing stepped part is formed between each of the storage recesses 74 and the elongated recess 75 (FIGS. 7, 8, and 10). The backup plate 76 is made of metal and formed with four through holes 77, as shown in FIG. 11, in which the small diameter tubular parts 73*b* of the sleeves 73 pass in an upward direction. Each of the through holes 77 is formed with a receiving seat 78 of a countersink of which an inner surface is inclined upwardly and outwardly from the inner radius. The receiving seat 78 is structured wherein an O-ring 79 can be seated. In addition, a top surface 76*a* of the backup plate 76 is a surface that confronts the passage plate 24*a*.

In this structure, when the sleeves 73 are inserted into the bottom plate 7*a* from the bottom surface in such a manner to fit the large diameter tubular parts 73*a* within the storage recesses 74, the small diameter tubular parts 73*b* of the sleeves 73 protrude from the storage recesses 74 toward the elongated recess 75. The backup plate 76 is placed in the elongated recess 75 from the top surface of the bottom plate 7*a* with the top surface 76*a* of the backup plate 76 facing upward, so that the small diameter tubular parts 73*b* of the sleeves 73 are fitted in the through holes 77. The O-rings 79 are fitted around the small diameter tubular parts 73*b*, and the passage plate 24*a* of the container 24 is overlaid on the bottom plate 7*a*. The fixing plate 80 is placed on the passage plate 24*a*, and fastened to the bottom plate 7*a* using a bolt 81 passing through a hole in the fixing plate 80 (FIG. 10). As the backup plate 76 is held at the stepped parts between each of the storage recesses 74 and the elongated recess 55, when the bolt 81 is fastened into the bottom plate 7*a*, the O-rings 79 are pressed against the inclined surfaces of the receiving seats 78 in the backup plate 76 and resiliently deformed. As soon as the inner radius surface of each O-ring 79 contacts the outer surface of the small diameter tubular part 73*b* of each sleeve 73, the top surface of the O-ring 79 contacts the bottom surface of the passage plate 24*a* around the outlet 26*a*. This prevents ink leakage from the connection between the sleeve 73 and the outlet 26*a*.

Therefore, ink in each air trap 23 of the container 24 passes through the filter 25, flows into the corresponding ink path 26 and sleeve 73, and is supplied from the filter 60 on the cavity plate unit 27 to the ink supply ports 59*a*.

Figure 10B:
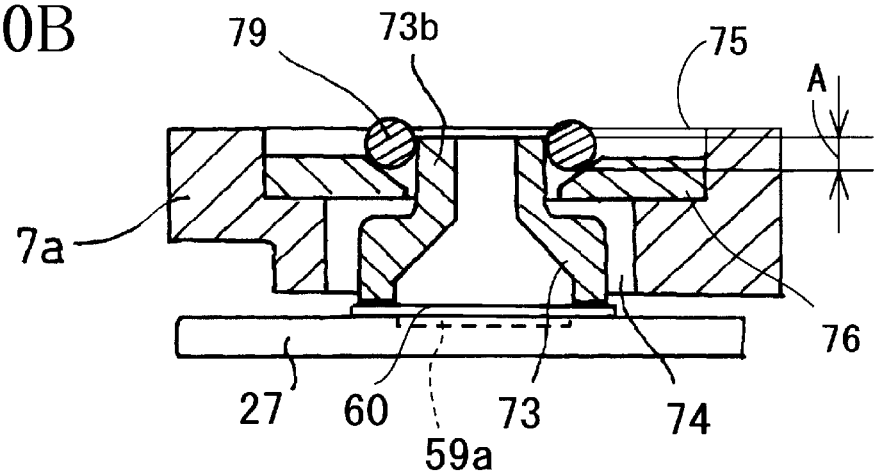
FIG. 10B is a sectional view of the head holder before the container is fixed.
Figure 11A:
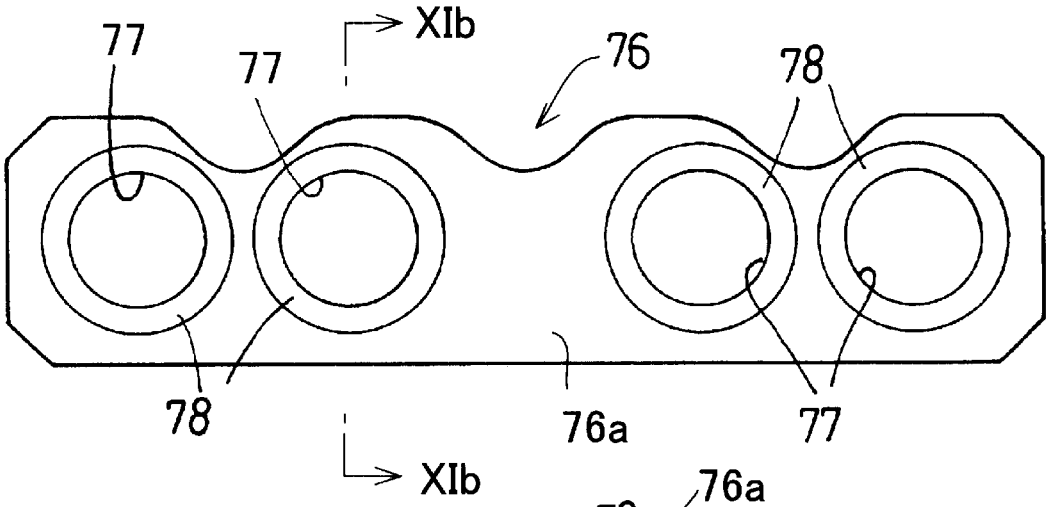
FIG. 11A is a plan view of a backup plate.
Figure 11B:
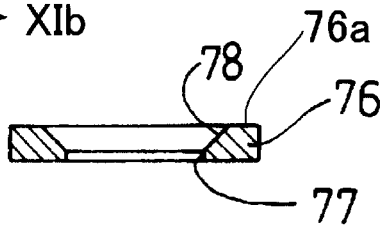
FIG. 11B is a cross sectional view taken along line XIb—XIb of FIG. 11A.

To ensure sealability by deformation of the O-ring 79, in a condition before the O-ring 79 is compressed as shown in FIG. 10B, it is preferable that a dimension from the upper end of the small diameter tubular part 73*b* of each sleeve 73 to the lower end of the O-ring 79 is 70% or more of the diameter of the O-ring 79 and the thickness of the backup plate 76 is 50% or less of the diameter of the O-ring 79.

When the passage plate 24*a* and the bottom plate 7*a* are fastened using the bolt 81 with a specified fastening force, if the upper surface of the sleeve 73 has abutted with the passage plate 24*a* before the O-ring 79 deforms, the upper surface of the cavity plate unit 27 of the recording head 10, fixed to the lower surface of the bottom plate 7*a*, may come off from the lower end of the sleeve 73 and the cavity plate unit 27 may be deformed. Therefore, dimensions should be taken so as to provide a clearance between the upper surface of the cavity plate unit 27 and the lower surface of the bottom plate 7*a* and a clearance between the upper surface of the sleeve 73 and the passage plate 24*a* in the above fastened condition.

Figure 12A:
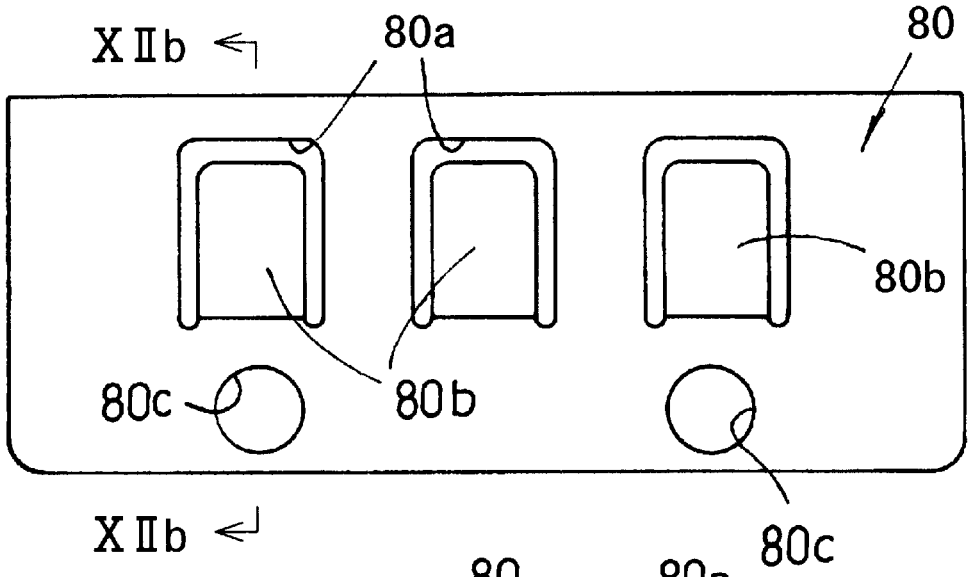
FIG. 12A is a plan view of a fixing plate.
Figure 12B:
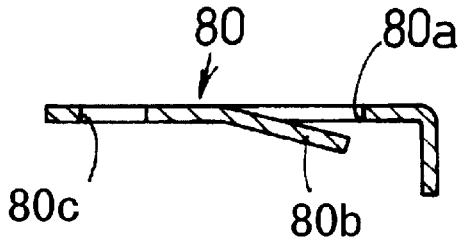
FIG. 12B is a cross sectional view taken along line XIIb—XIIb of FIG. 12A.

As shown in FIGS. 12A and 12B, the fixing plate 80 is provided with cuts 80*a* spaced along the arrangement of the sleeves 73 and leaf springs 80*b* which are each connected at one side to the fixing plate 80 and have a free end which is bent downward from the corresponding cuts 80*a*. When the fixing plate 80 and the bottom plate 7*a* are fastened, using the bolt 80, with the passage plate 24 sandwiched therebetween, each free end of the leaf springs 80*b* presses against the upper surface of the passage plate 24*a* at an end remote from the bolt 80 (where the bottom plate 7*a* and the passage plate 24*a* are free), so that the O-rings 79 are held by the backup plate 76 and brought into contact with the bottom surface of the passage plate 24*a*. Therefore, even when the passage plate 24*a* and the bottom plate 7*a* are deformed to such an extent as to create a gap therebetween due to reactive force incident to resilient deformation of the O-rings 79, the sealed fit by the O-rings 79 can be reliably obtained by the leaf springs 80*b*.

As described above, when the container 24 and the bottom plate 7*a* are fastened after the O-rings 79, which are fitted around the sleeves 73, and the backup plate 76, are interposed between the bottom plate 7*a* and the passage plate 24*a* of the container 24, the O-rings 79 are resiliently deformed via the backup plate 76 supported by the bottom plate 7*a*. This deformation can perfectly fill the gaps in the connections between the sleeves 73 and the corresponding outlets 26*a* of the ink paths 26, thereby lowering gas permeability and reducing the entry of air. As a result, the number of times suction purging operations are needed can be reduced and unnecessary consumption of ink can be avoided.

Further, the container 24 can be easily removed from the head holder 7 for replacement if the filter 25 in the container 24 becomes clogged with a foreign substance. The O-rings 79 and the backup plate 76 can be easily removed from the bottom plate 7*a* with the recording heads 10 and the sleeves 73 remaining fixed at the head holder 7, if the nozzles 55 of the recording heads 10 become clogged with ink.

Figure 13:
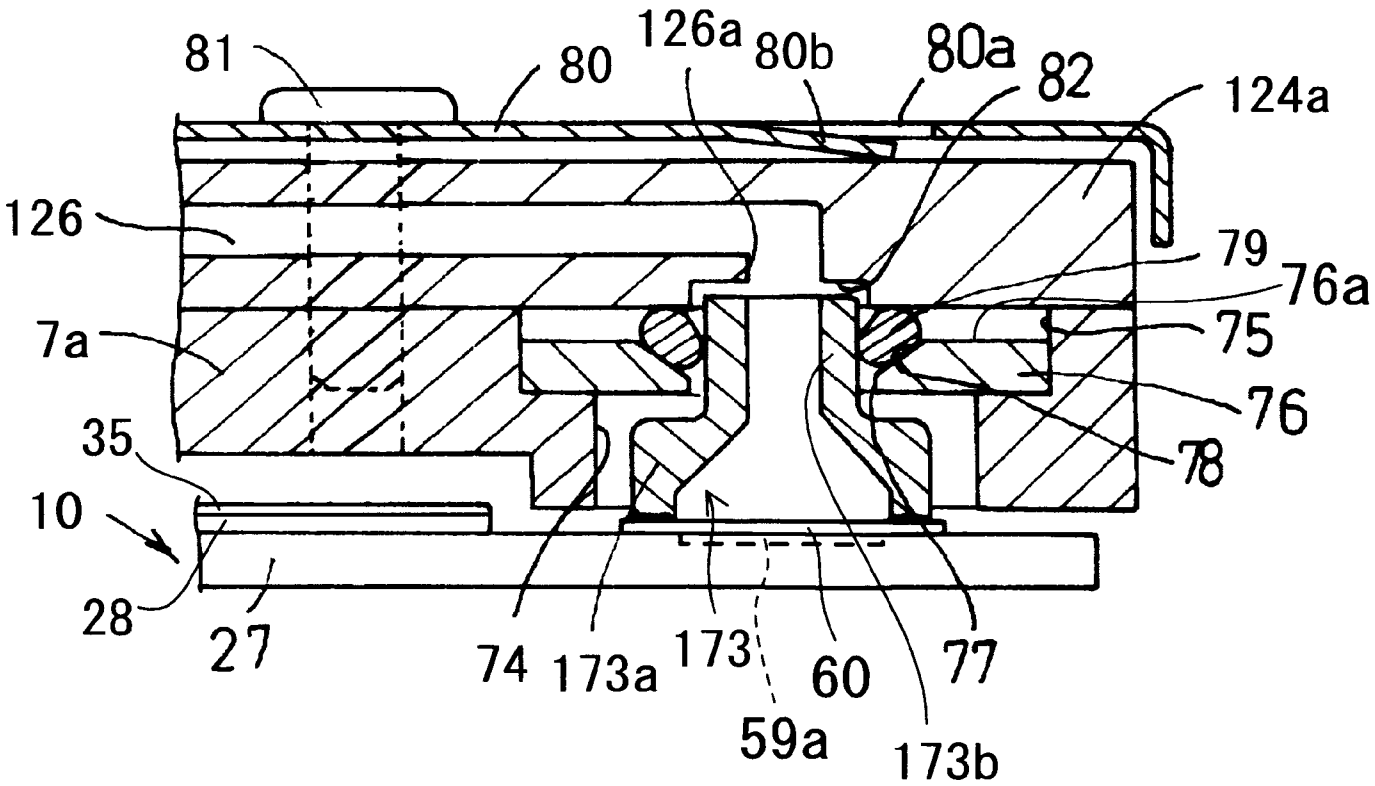
FIG. 13 is an enlarged sectional view of essential parts of a second embodiment of the sealing structure.

FIG. 13 shows essential parts of a second embodiment of the sealing structure shown in FIG. 10, in an enlarged sectional view. In this embodiment, a small diameter tubular part 173*b* of each sleeve 173 is longer than the small diameter tubular part 73*b* of the first embodiment. Therefore, a distance from a point where the O-ring 79 makes contact with the small diameter tubular part 173*b* to the upper end of the small diameter tubular part 173*b* increases in length as compared with the first embodiment. As a result, even if a passage plate 124*a* of the container 24 and the bottom plate 7*a* are resiliently deformed, the sealed fit by the O-rings 79 can be more reliably obtained as compared with the first embodiment. In addition, an outlet 126*a* of each of ink paths 126 formed in the passage plate 124*a* is provided with a recess 82, which is formed inward from the bottom surface of the passage plate 124*a*, and which holds the upper end of the small diameter tubular part 173*b* of each sleeve 173. As the structure except for the above, is the same as those in the first embodiment, the detailed description of parts already presented for the first embodiment is omitted for simplicity by designating the same elements with similar numerals. According to this structure, when the bolt 81 is fastened into the bottom plate 7*a*, with the passage plate 124*a* sandwiched between the fixing plate 80 and the bottom plate 7*a*, each O-ring 79 is resiliently deformed in a direction of height necessary to maintain the seal yet provide a clearance between each recess 82 and the upper end of the small diameter tubular part 173*b* of each sleeve 173 with the upper end of the small diameter tubular part 173*b* received in the recess 82. In addition, there is no need to make the passage plate 124*a* thin so as to hold the small diameter tubular part 173*b* because the upper end of the small diameter tubular part 173*b* is received in the recess 82.

Figure 14:
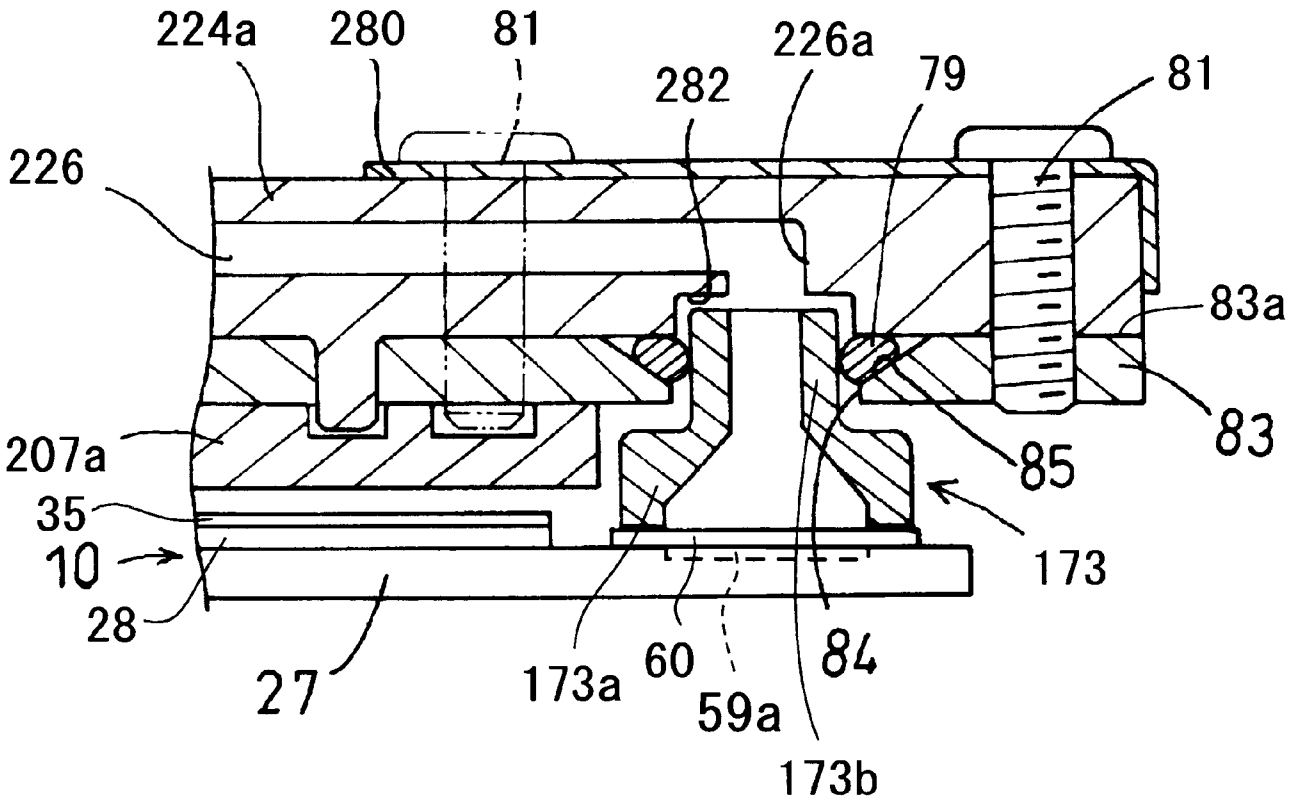
FIG. 14 is an enlarged sectional view of essential parts of a third embodiment of the sealing structure.

FIG. 14 shows essential parts of a third embodiment of the sealing structure shown in FIG. 10, in an enlarged sectional view. In this embodiment, a bottom plate 207*a* of the head holder 7 has no holes or recesses for mounting the sleeves 173. A backup plate 83 is interposed between the bottom plate 207*a* and a passage plate 224*a* of the container 24 extends outward from the bottom plate 207*a*. The backup plate 83 is provided with through holes 84 in which the small diameter tubular parts 173*b* of the sleeves 173 are fitted. Each of the through holes 84 is defined with a receiving seat 85 of a countersink at a top surface 83*a* of the backup plate 83. An outlet 226*a* of each ink path 226 in the passage plate 224*a* is also formed with a recess 282, as is the case with the second embodiment. The bottom plate 207*a* of the head holder 7 is fixedly mounted to the backup plate 83 to prevent misalignment.

According to the embodiment, when the backup plate 83 and the passage plate 224*a* are fastened using bolts 281 and a fixing plate 280, each O-ring 79 is pressed against the inclined surface of the receiving seat 85 and resiliently deformed inward along the radius thereof, and reliably seals the gap between the circumference of the small diameter tubular part 173*b* and the outlet 226*a* of the passage plate 224*a*. In addition, as the fastening does not directly affect the head holder 7, the recording heads 10 fixed to the bottom surface of the head holder 7 do not become deformed.

In the above embodiments, the backup plate 76, 83 and the sleeves 73 may be formed of synthetic resin or metal. When the backup plate 76, 83 is formed of metal, it may be provided with ribs and beads by pressing so as to decrease plate flexure by the fastening.

Figure 15:
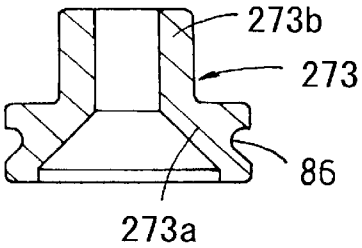
FIG. 15 is a sectional view of another embodiment of a sleeve.

FIG. 15 shows an alternative embodiment of the sleeve 73. In this embodiment, a sleeve 273 is provided with a recessed groove 86 around a large diameter tubular part 273*a*. Another O-ring (not shown) is fitted in the recessed groove 86 thereby improving sealability at the position where the sleeve 273 is mounted in the storage recess 74 of the head holder 7.

The printed circuit board 32 is fixed on the top surface of the ink jet head unit 5, as shown in FIGS. 2, 3, and 4. On the upper surface of the printed circuit board 32, a rectangular connector 33 is fixed in substantially parallel with the main guide rail 3. The connector 33 has a lid 33*b* that pivots on a connector base 33*a*, and a plurality of contact points are arranged on the connector base 33*a* with a fixed pitch (0.5-mm pitch in this embodiment) in a longitudinal direction thereof. A flexible flat cable 34 is connected to an external device, such as a computer (not shown) or a controller in the body case 2 at one end, and placed on the connector base 33*a* at the other end in such a manner that terminals thereof are aligned with the contact points on the connector base 33*a*. When the lid 33*b* is closed in this condition, the terminals of the flat cable 34 and the contact points of the connector base 33*a* are electrically continuous. A flat cable 35 is soldered on the bottom surface of the printed circuit board 32 at one end. The flat cable 35 is, at the other end, fixed and electrically connected to the actuator 28 in the recording head 10 outside the container 24 and on a side opposite to that where the ink outlet 19 is disposed.

In a normal condition where the flat cable 34 is connected to the connector 33, a command to form an image or a drive signal for image data is transmitted from an external device, such as a computer (not shown) or the controller in the body case 2 (not shown), to the printed circuit board 32 via the flat cable 34, and the actuator 28 is driven.

When the lid 33*b* is opened upward, the contact points of the connector base 33*a* and the corresponding terminals of the flat cable 34 are easily disconnected and the ink jet head unit 5 is also easily removed from the scanning carriage 6 as described later. Therefore, maintenance of the ink jet head unit 5, for example, replacement, is very simple.

The structure to remove the ink jet head unit 5 from the scanning carriage 6 and fix the ink jet head unit 5 to the scanning carriage 6 will be described. FIGS. 2, 3, and 4 show one embodiment of such a structure. Guide rails 40 are provided on lower edges of inner sides of the supporting frames 6*c* in the scanning carriage 6. Recessed guide grooves 41, which are to be engaged with the corresponding guide rails 40, are provided on both outer sides of the ink jet head unit 5. The guide rails 40 and the guide grooves 41 bring the recording heads 10 near to the joint 9 in a direction substantially parallel to a surface of each of the recording heads 10 provided with the nozzles 55. Alternatively, protruding guide rails may be formed on the ink jet head unit 5 and recessed grooves may be formed on the supporting frames 6*c* of the scanning carriage 6.

An engaging member 42 is formed of metal wire which is bent in an angular C shape in a plan view, and has legs 42*b* and ends 42*a* bent inward. The engaging member 42 is rotatably mounted to the ink jet head unit 5 by attaching the ends 42*a* to the front part (which is on an end remote from the proximal part 6*a*) on both sides of the ink jet head unit 5.

A recessed engaged member 43 is formed between the proximal part 6*a* and the joint storing part 6*b* on the top surface of the scanning carriage 6, so that an engaging part 42*c* connecting the legs 42*b* of the engaging member 42 is fitted therein.

According to the above structure, when maintenance, for example, replacement of the recording heads 10 or the container 24 in the ink jet head unit 5, is performed, the flat cable 34 is removed from the connector 33, the engaging part 42*c* of the engaging member 42 is unlatched from the engaged member 43 of the scanning carriage 6, and the ink jet head unit 5 is pulled out horizontally from the scanning carriage 6. After maintenance is performed, the ink jet head unit 5, which is separated from the scanning carriage 6 mounted to the main guide rail 3, as shown in FIG. 4, is inserted substantially horizontally between the supporting frames 6*c* of the scanning carriage 6 with the recording heads 10 facedown. In other words, the ink jet head unit 5 is inserted into the scanning carriage 6 so as to face the ink inlets 21*a*–21*d* at the rear of the ink jet head unit 5 with the ink outlets 19*a*–19*d* at the front of the scanning carriage 6. At this time, the guide grooves 41 on both sides of the ink jet head unit 5 are guided by the guide rails 40 on the inner sides of the supporting frames 6*c*, all the ink inlets 21*a* to 21*d* are brought into face-to-face abutment with the corresponding ink outlets 19*a* to 19*d* while being fitted into the seal rings 22 covering the ink outlets 19*a* to 19*d*. This insertion allows fluid communication between the ink inlets 21*a* to 21*d* and the ink outlets 19*a* to 19*d*. With this condition, the engaging member 42 is rotated in such a manner that the legs 42*b* surround the supporting frames 6*c* of the scanning carriage 6 from outside, and the engaging part 42*c* is fixedly latched at the recessed engaged member 43 on the top surface of the scanning carriage 6 through the use of the elasticity of the engaging member 42. This prevents the ink jet head unit 5 from becoming disconnected from the scanning carriage 6, and enables tight connection between the ink inlets 21*a* to 21*d* and the ink outlets 19*a* to 19*d*, so that leakage of ink therebetween is reliably prevented.

After engagement between the engaging member 42 and the engaged member 43, the terminals of the flat cable 34 are aligned with corresponding contact points on the connector base 33*a*. When the lid 33*b* is closed, electric connection is established. As the flat cable 34 and the connector 33 are disposed on the top surfaces of scanning carriage 6 and the ink jet head unit 5 (opposite to the surfaces of the recording heads 10 provided with the nozzles 55), connection and disconnection of the flat cable 34 can be easily done in a wide workspace.

To make sure of the engagement between the scanning carriage 6 and the ink jet head unit 5, the angular C-shaped engaging member 42 may be attached to the scanning carriage 6 so as to be movable on the ends 42*a* and the engagement member 43 may be formed in the ink jet head unit 5. In addition, the engaging member 42 of a wire may be formed in the form of a hook lever.

The sub-guide rail 45 (FIG. 3) is engaged in a guide groove 44 at the front of the ink jet head unit 5 and fixed to the frame 4 of the body case 2. As a result, the scanning carriage 6 and the ink jet head unit 5 are supported by the main guide rail 3 and the sub-guide rail 45 respectively, and are movable in the main scanning direction while keeping a clearance between the surfaces of the recording heads 10 provided with the nozzles 55, which are placed on the lower surface of the ink jet head unit 5, and a feeding path of a sheet P constant.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. An ink jet printer head, comprising:

a head holder that includes a supporting plate;

a recording head that includes an array of nozzles on a bottom surface through which ink is ejected and an ink supply port on a top surface that supplies ink to the nozzles, the recording head fixed on the supporting plate;

an ink path forming member that includes an ink path and an outlet and is fixed on a top surface of the supporting plate;

a tubular sleeve that protrudes from the ink supply port of the recording head and is disposed so as to allow communication between the recording head and the outlet of the ink path;

a backup plate that encloses a perimeter of the sleeve and is interposed between the recording head and the ink path forming member;

an annular resilient sealing member that is inserted around the perimeter of the sleeve between the backup plate and the ink path forming member; and a fastener that fastens the backup plate to the ink path forming member, wherein the annular resilient sealing member is resiliently deformed by the backup plate so as to prevent ink leakage from a connection between the perimeter of the sleeve and the outlet of the ink path.

2. The ink jet printer head according to claim 1, wherein the supporting plate has a hole, and the sleeve, the annular resilient sealing member, and the backup plate are disposed in the hole.

3. The ink jet printer head according to claim 2, wherein the supporting plate has a stepped part inside the hole, the backup plate is interposed between the stepped part and the ink path forming member, and the supporting plate and the ink path forming member are fastened by the faster.

4. The ink jet printer head according to claim 3, wherein the backup plate has a through hole, and a receiving seat that supports the annular resilient sealing member at the perimeter of the sleeve and a surface that confronts the ink path forming member are formed around a rim of the through hole.

5. The ink jet printer head according to claim 3, wherein the ink path forming member includes a recess provided around a perimeter of the outlet, and an upper end of the sleeve is held in the recess.

6. The ink jet printer bead according to claim 2, further comprising:

a plate that has a resilient deforming part, wherein the plate is fastened to a top surface of the ink path forming part and the resilient deforming part presses the ink path forming part.

7. The ink jet printer head according to claim 2, wherein the backup plate is interposed between the supporting plate and the ink path forming member and the ink path forming member and the backup plate are fastened by the fastener.

8. The ink jet printer head according to claim 7, wherein the ink path forming member includes a recess provided around a perimeter of the outlet, and an upper end of the sleeve is held in the recess.

9. The ink jet printer head according to claim 2, wherein the sleeve is made up of a small diameter tubular part and a large diameter tubular part, and a tubular resilient sealing member is fitted around the large diameter part.

10. A connection between a container and a recording head, comprising:

a container body having a passage plate with at least one ink path formed therein;

a plate mounted to a surface of the passage plate without obstructing any ink path;

a backup plate mounted between at least a portion of the passage plate and the plate and having an opening opposed to each ink path;

a tubular sleeve having a first diameter section and a second diameter section, the first diameter section received in a corresponding opening in the backup plate;

a ring mounted to the first diameter section of each tubular sleeve between the backup plate and the passage plate, each opening in the backup plate having a chamfer around an edge of the opening on a side toward the passage plate, the ring received in the chamfer; and a compressing mechanism that tightly joins the plate and the passage plate.

11. The connection according to claim 10, wherein the compressing mechanism comprises:

a fixing plate mounted over a surface of the passage plate opposite the surface to which the plate is mounted; and at least one screw passing at least through the passage plate and threadably received in the plate.

12. The connection according to claim 11, wherein the fixing plate has a plurality of integral leaf springs that press against the passage plate.

13. The connection according to claim 11, wherein each ink path has an end large enough to receive the first diameter section of tubular member therein.

14. The connection according to claim 10, wherein the plate has an opening opposing each ink path.

15. The connection according to claim 10, wherein the plate terminates short of the at least one ink path in the passage plate.

16. The connection according to claim 15, wherein the compressing mechanism comprises:

a fixing plate mounted over a surface of the passage plate opposite the surface to which the plate is mounted; and at least one screw passing through the passage plate and threadably received in the plate.

17. The connection according to claim 10, wherein the tubular sleeve has a filter attached to an end of the second diameter section, the filter contacting the recording head.

18. The connection according to claim 10, wherein the tubular sleeve has a groove around an outer surface of the second diameter section.

19. The connection according to claim 10, wherein the diameter of the first diameter section is smaller than the diameter of the second diameter section.

* * * * *